US006526884B1

(12) United States Patent
Bardet et al.

(10) Patent No.: US 6,526,884 B1
(45) Date of Patent: Mar. 4, 2003

(54) DETACHABLE INKING DEVICE FOR A FLEXOGRAPHIC PRINTING MACHINE, ITS EMBODIMENT, CLEANING AND USE IN SUCH A MACHINE

(75) Inventors: Gilbert Bardet, Lausanne (CH); Daniel Hürlimann, Prangins (CH); Patrick Lüscher, Cossonay-Ville (CH); Jean-Bernard Morisod, Villars-Ste-Croix (CH); Michel Piguet, Renens (CH)

(73) Assignee: Bobst S.A. (CH)

( * ) Notice: Subject to any disclaimer, the term of this patent is extended or adjusted under 35 U.S.C. 154(b) by 0 days.

(21) Appl. No.: 09/517,476

(22) Filed: Mar. 2, 2000

(30) Foreign Application Priority Data

Mar. 5, 1999 (CH) ..... 0412/99

(51) Int. Cl.[7] ..... B41F 31/00
(52) U.S. Cl. ..... 101/350.6; 101/169
(58) Field of Search ..... 101/350.6, 363, 101/366, 169

(56) References Cited

U.S. PATENT DOCUMENTS

| | | | | |
|---|---|---|---|---|
| 4,590,855 A | | 5/1986 | Schommer et al. | |
| 4,821,672 A | * | 4/1989 | Bruno | 101/366 |
| 4,938,133 A | | 7/1990 | Bock et al. | |
| 5,072,669 A | * | 12/1991 | Weisbrod et al. | 101/366 |
| 5,125,341 A | * | 6/1992 | Yaeso | 101/367 |
| 5,150,651 A | | 9/1992 | Flores | |
| 5,165,342 A | * | 11/1992 | Weishew | 101/350.6 |
| 5,406,887 A | * | 4/1995 | Hertel et al. | 101/350.6 |
| 5,410,961 A | * | 5/1995 | Denicola et al. | 101/366 |
| 5,524,540 A | * | 6/1996 | Van Denend | 101/366 |
| 5,662,042 A | * | 9/1997 | Compton et al. | 101/366 |
| 5,735,210 A | * | 4/1998 | Rogge et al. | 101/366 |
| 5,967,042 A | * | 10/1999 | Chiloff | 101/350.6 |
| 5,983,797 A | * | 11/1999 | Secor | 101/350.6 |
| 6,095,045 A | * | 8/2000 | Peterson et al. | 101/350.6 |

FOREIGN PATENT DOCUMENTS

| | | |
|---|---|---|
| EP | 0359959 | 3/1990 |
| EP | 0611649 | 8/1994 |

* cited by examiner

*Primary Examiner*—Eugene H. Eickholt
(74) *Attorney, Agent, or Firm*—Ostrolenk, Faber, Gerb & Soffen, LLP

(57) ABSTRACT

A detachable inking device for a flexographic printing machine, a manipulating device for removing and replacing the inking device, a cleaning device, and a repair station for refurbishing the inking device. The inking device itself is a chambered doctor blade (9) mounted on two lever-supports (13, 14) through which ink is supplied from a reservoir. The lever-supports are rigidly attached to a shaft (11) which is pivotable between the frames (34) of the flexographic printing machine. The chambered doctor blade has a body (25) made of light material, crossed at one of its ends by a tube (26) emerging from the bottom (28) of body (25), and at the other end by a tube (40) having its opening part (29) at level with the bottom (28) of the body (25). The latter rests on seals (38, 39) secured to the lever-supports (13, 14) to which are attached centering and fixing means (17, 18) allowing a quick loosening of the chambered doctor blade (9) without the help of any tool. The body (25) comprises two planar outwardly slanted projecting parts against which are adhesively attached two doctor blades elements. The doctor blade elements are also held at their ends by a supporting piece (21) having two supporting flanges (35, 36) that engage the ends of the doctor blade elements (19, 20).

7 Claims, 8 Drawing Sheets

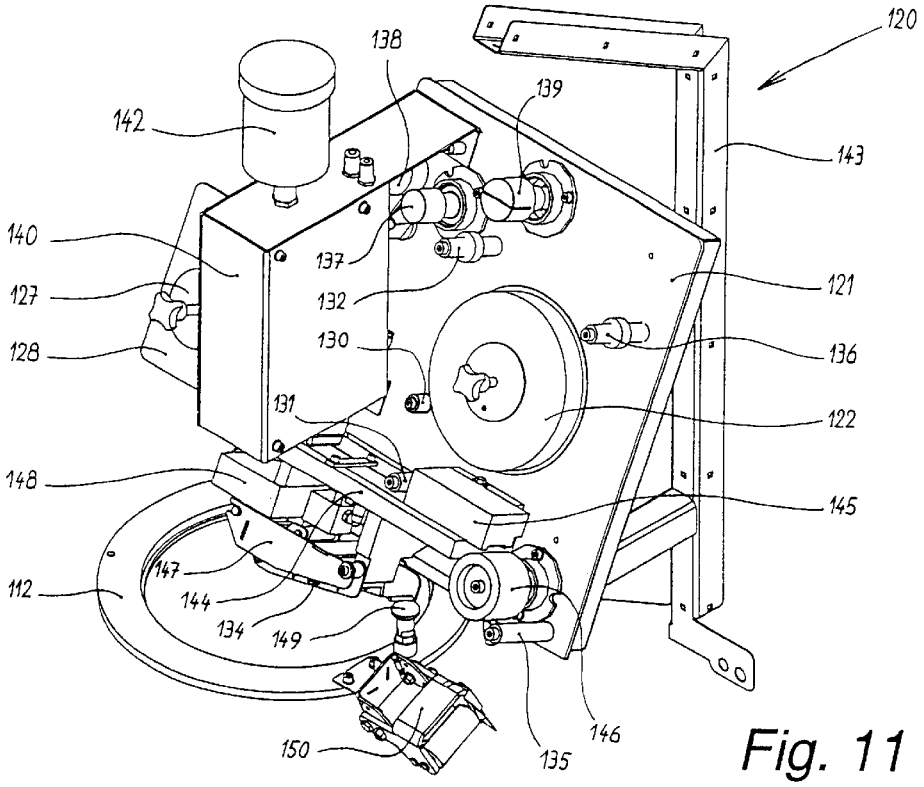
Fig. 11
Fig. 12
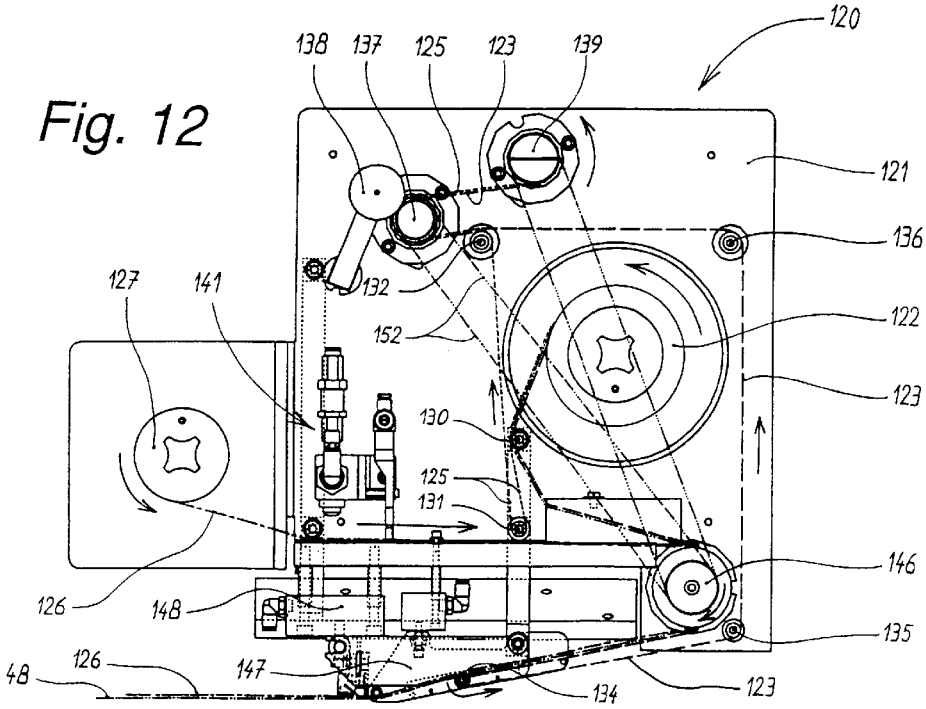

DETACHABLE INKING DEVICE FOR A FLEXOGRAPHIC PRINTING MACHINE, ITS EMBODIMENT, CLEANING AND USE IN SUCH A MACHINE

BACKGROUND OF THE INVENTION

1. Field of the Invention

The present invention refers to a detachable inking device for a flexographic printing machine, its embodiment, cleaning and use in such a machine.

2. Description of the Related Art

The flexographic printing machines and, more particularly the printing stations of these machines comprise a plate cylinder, a pressure roller, a screen cylinder, commonly called anilox cylinder by the experts, and an inking device. The matter to be printed passes between the plate cylinder and the pressure roller. The screen cylinder, on which ink has been previously applied by the inking device, deposits the ink on the plate cylinder. To obtain four-color prints, for example, four printing stations are used, each printing a different color. The inking devices, being generally used in the printing machines to deposit ink on the screen cylinder, are made up of a chambered doctor blade comprising a body on which are mounted two doctor blades coming in contact with the circumference of the screen cylinder. The ends of the chambered doctor blade are sealed by seals. The assembly thus formed consistutes a tank or chamber, into which the ink is supplied through an inking circuit, by means of a pump.

Obviously, the printing machines, such as referred here, must be easily set up for different printing jobs and in order to do so, all the components of each printing station need to be thoroughly cleaned. This thorough cleaning is relatively easy for components such as the plate cylinder and the screen cylinder but is more difficult as regards the chambered doctor blade, on which ink residues often remain even after an intensive cleaning. Each document U.S. Pat. No. 4,590,855, 5,150,651, EP 0 359 959 B1 and EP 0 611 649 B1 describe an inking devices being similar to the one we have just referred to.

The document U.S. Pat. No. 4,590,855 relates to a chambered doctor blade wherein the doctor blades are mounted on a body by means of a small bar and a hexagonal head screw. The tightness of the chambered doctor blade ends is achieved by a seal cut according to the diameter of the screen cylinder. An identical seal is fixed to each end of the chambered doctor blade body by means of a small plate crossed by hexagonal head screws ensuring the clamping of the assembly. This chambered doctor blade is arranged so as to be pivotable from a working position against the screened cylinder to a rest position in which it is relatively easy to exchange used or damaged doctor blades. Obviously, in this position, an additional operation, for example cleaning, can be carried out because of the access to the internal parts of the chambered doctor blade.

The document U.S. Pat. No. 5,150,651 describes a chambered doctor blade wherein the doctor blades are also mounted on the chambered doctor blade body by means of a small bar and a hexagonal head screw. In this device, the concern is depositing ink in some transverse areas of the screened cylinder. For this purpose, the tightness of these areas, in the chambered doctor blade, is provided by seals which are cut according to the diameter of the screened cylinder and the configuration of the internal part of the chambered doctor blade. Once that these seals are in the required position, they are maintained by the clamping of the doctor blades acting on a part of the seal. This chambered doctor blade is also arranged so as to be pivotable from a working position against the screen cylinder to a rest position in which it is relatively easy to exchange used or damaged doctor blades and to adjust the position of the seals in the width of the chambered doctor blade. Also obviously, in this position, an additional operation, for example cleaning, can be carried out because of the access to the internal parts of the chambered doctor blade.

The document EP 0 359 959 B1 refers to a doctor blade inking device comprising a chambered doctor blade being detachably fixed on a crossbar which extends parallel to the screen cylinder. The crossbar includes fastenings for fitting or removing of at least one chambered doctor blade. The doctor blades are secured to the chambered doctor blade body in the same manner as has just been described with reference to the two previous patents. The assembly formed by the crossbar and the chambered doctor blade is also pivotable from an operating position to a rest position allowing the same handling operations as those previously cited in relation with the two mentioned US patents.

The document EP0 611 649 B1 relates to an inking apparatus wherein the doctor blades are held against the chambered doctor blade body by a clamping means comprising levers controlled by cylinders for clamping and loosening the doctor blades. In this device, the doctor blades are of magnetic material, such as a magnet, for temporarily holding the doctor blade against the chambered doctor blade before clamping it by the clamping device. This assembly, as those previously described, is also pivotably mounted in order to be able to carry out operations which are similar to the above-mentioned, this in a rest position.

As will be noted, in all the described devices the fitting and the fixing of the doctor blades achieves by means of clamping means consisting either of screws or of lever and cylinder devices applying their clamping force in unifrom manner all along the doctor blade. In one of the cited examples, it has been endeavoured to improve the contact between the doctor blades and the chambered doctor blade body by using a magnetic material for the doctor blades and a ferrous material for the chambered doctor blade body. As has been explained, the inking means need to be thoroughly cleaned at each change of color of the printing stations. Such a cleaning is also required when replacing a used or damaged doctor blade.

One of the major disadvantages of the devices using spaced clamping means lies in the fact that, when cleaning the chambered doctor blade there always remain ink residues attracted by capillarity between the internal part of the doctor blade and its supporting surface against the chambered doctor blade body. This phenomenon is particularly undesirable when changing from a dark color, for example black or blue, to a light color such as yellow. This lack of cleaning causes a fading of the desired new color, which is obviously unacceptable.

Another important disadvantage remains in the long time required for exchanging a used or damaged doctor blade. This is essentially due to the required removal and refitting of the numerous components which comprise the clamping means. Finally, the chambered doctor blades used in the known devices are of a heavy construction which renders their handling difficult when withdrawing them from the printing machine, which is required, for example for a repair or a thorough cleaning.

BRIEF SUMMARY OF THE INVENTION

The aim of the present invention is to obviate the above-mentioned disadvantages and proposing a detachable inking device comprising an extremely lightweight chambered doctor blade.

BRIEF DESCRPTION OF THE DRAWINGS

The invention will be more clearly understood from the following description of an embodiment of an inking device for a flexographic printing machine given by way of non-limitative example and illustrated by the accompanying drawings, in which.

Figure 7:
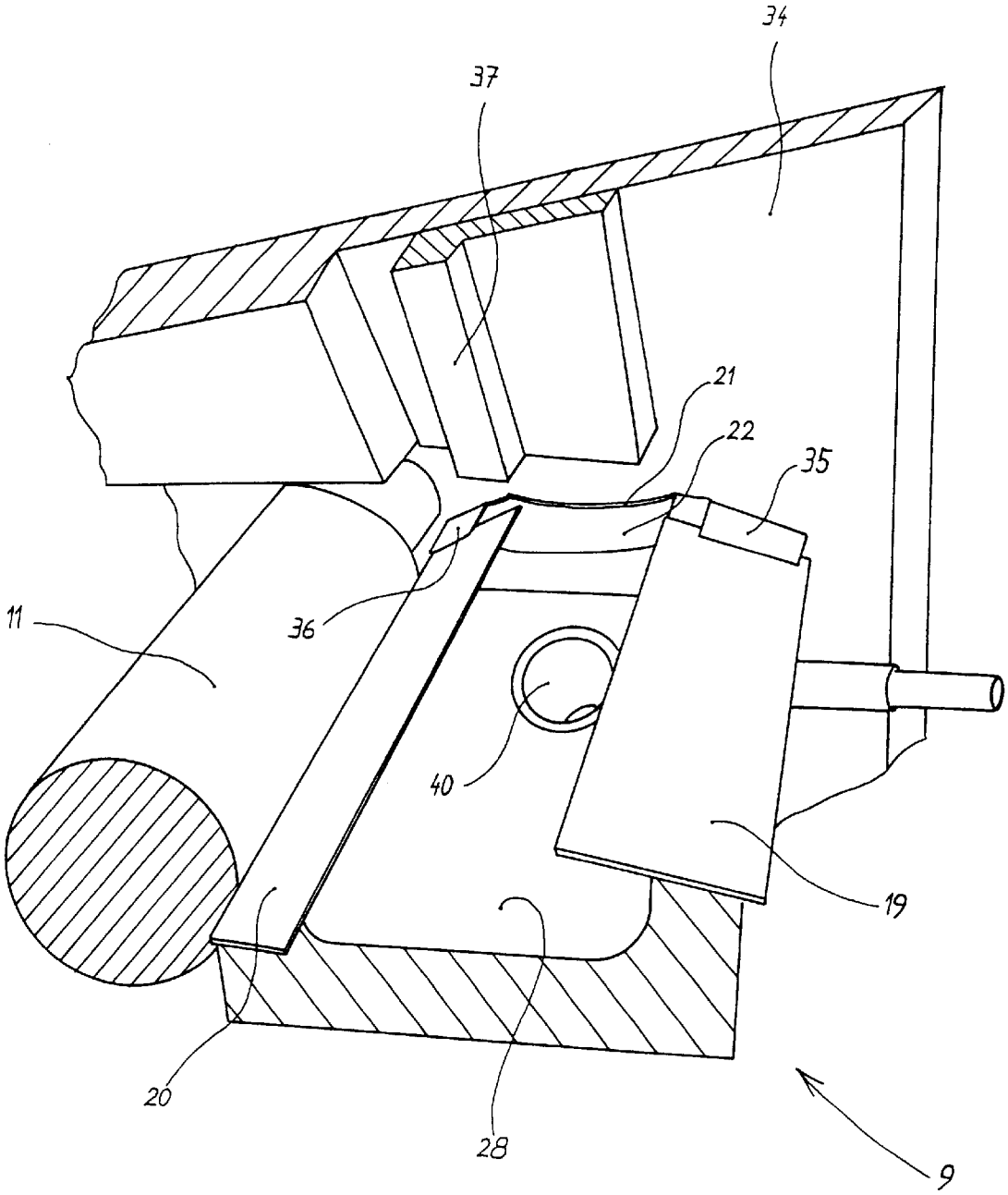
Figure 8:
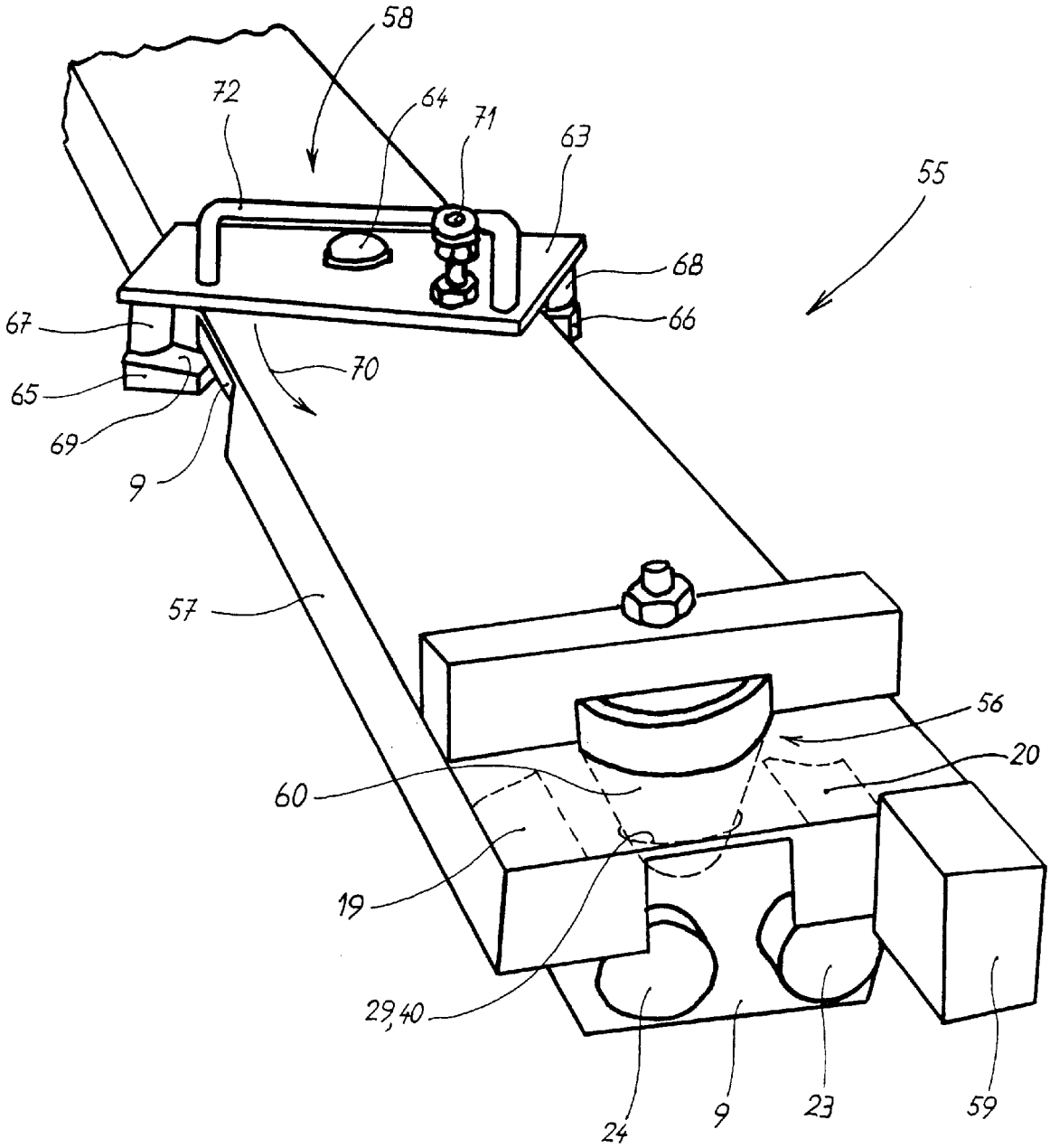
Figure 9:
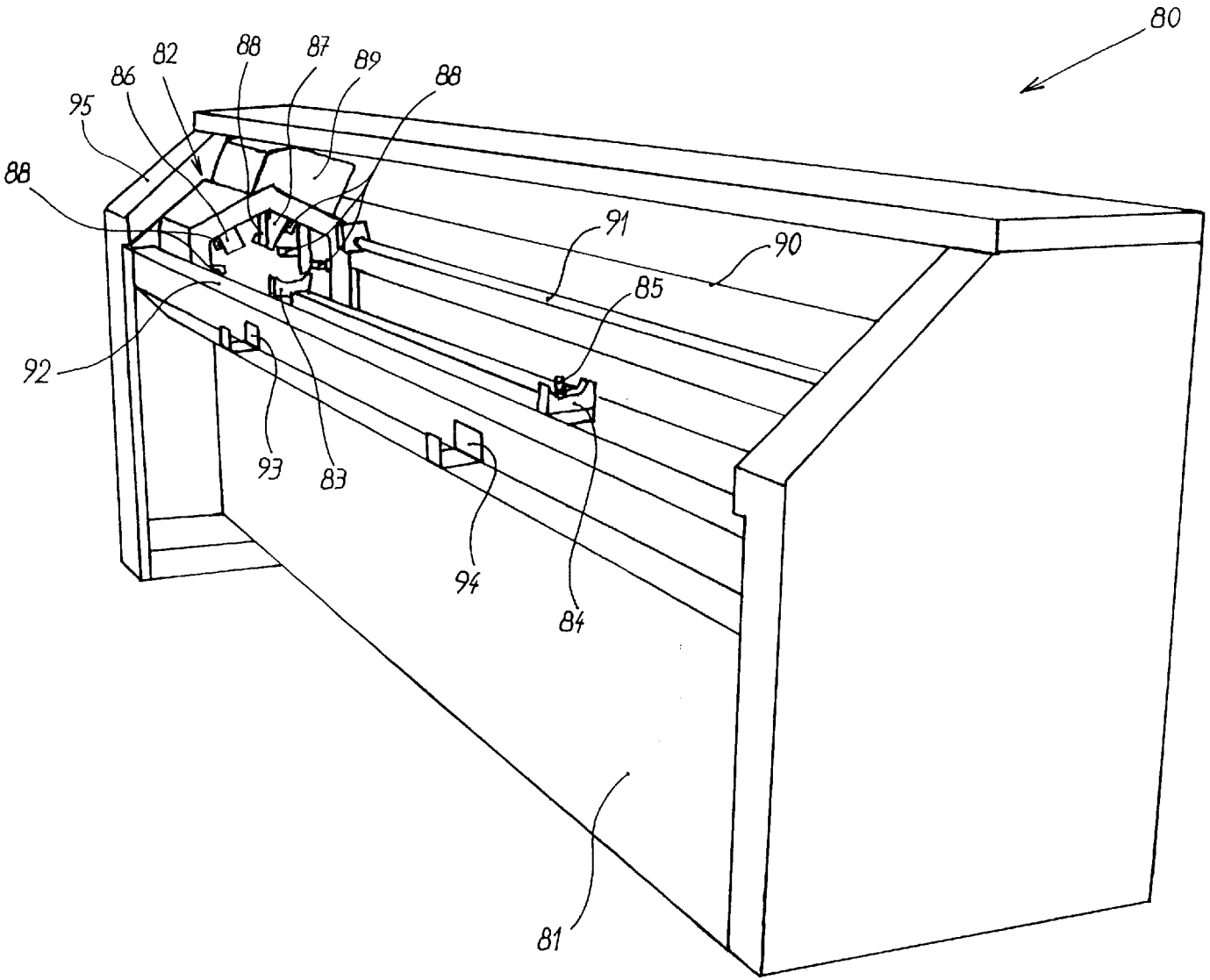
Figure 10:
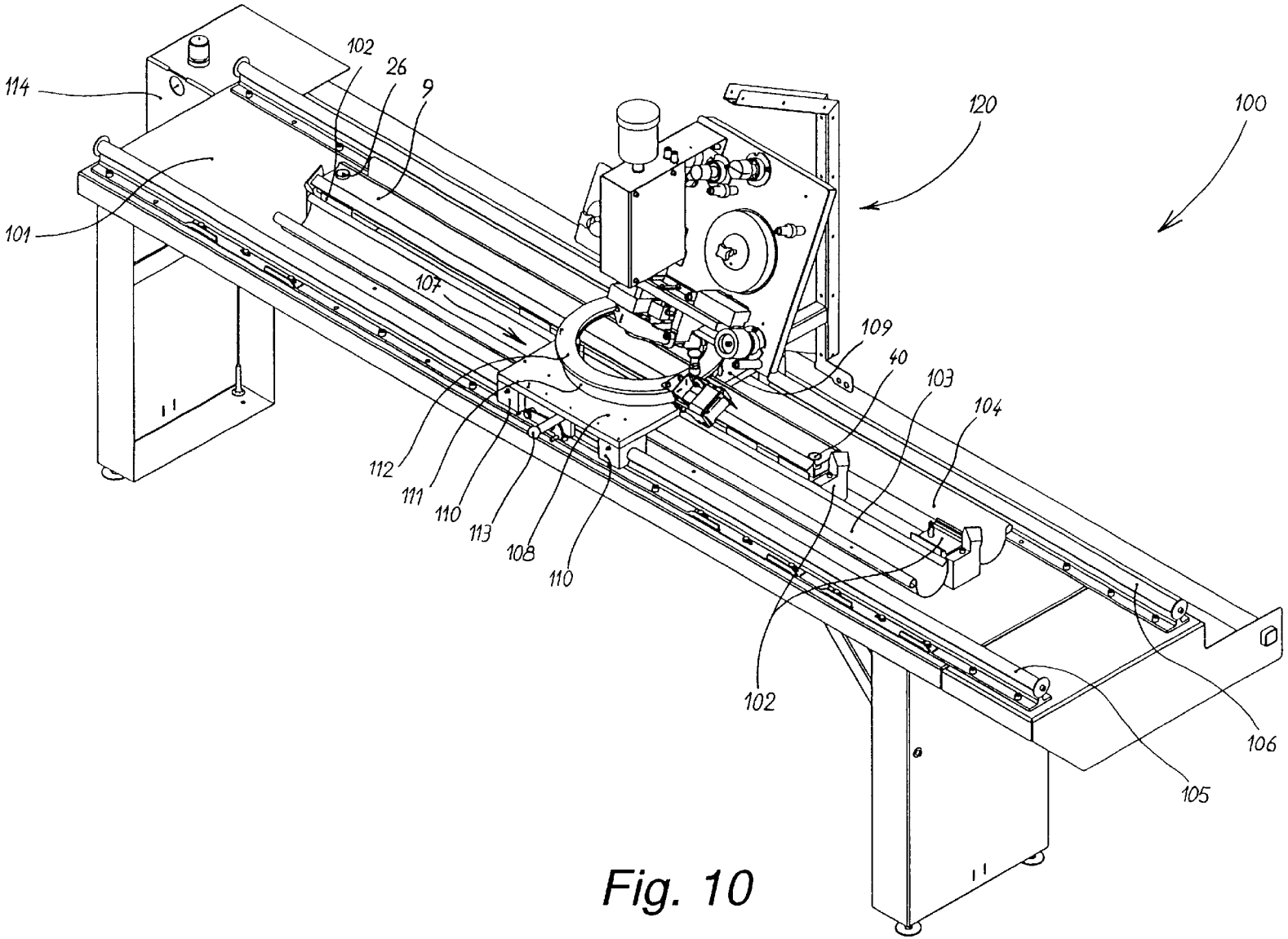

FIG. 7 is a perspective view of one of the ends of the chambered doctor blade, FIG. 8 is a perspective view of the handling device of the chambered doctor blade, FIG. 9 is a perspective view of the automatic washing device of the chambered doctor blade, FIG. 10 is a general perspective view of the gluing and ungluing device of the doctor blades, FIG. 11 is a perspective view of the gluing-ungluing means of the corresponding device, and FIG. 12 is a front view of the gluing-ungluing means.

DETAILED DESCRIPTION OF THE INVENTION

Figure 1:
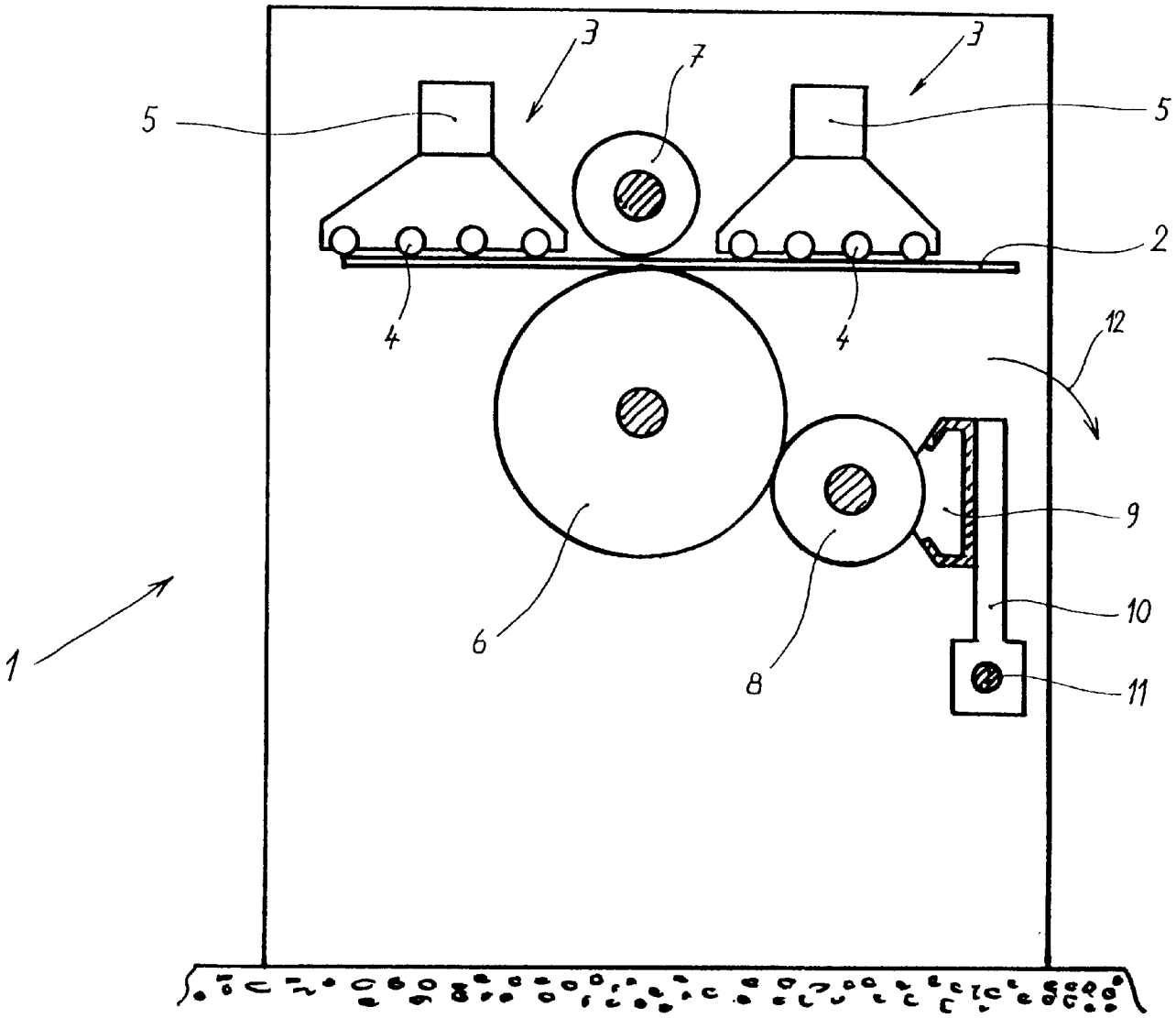
FIG. 1 is a schematic side view of a printing station.

FIG. 1 is a schematic side view of a printing station 1 wherein are represented the components of such a station. The sheets to be printed 2 are conveyed in a manner that their lower surface can be printed without interference from the lower conveyor means. For this purpose, means such as suction conveyors 3 are used, including drive rollers 4 secured to a suction device 5. The sheets to be printed 2, conveyed by the suction conveyors 3, are printed by a plate cylinder 6 cooperating with a pressure roller 7. The plate cylinder 6 receives the ink from a screen cylinder 8, commonly called an "anilox" cylinder. The screen cylinder 8 receives the required ink through a chambered doctor blade 9. This chambered doctor blade 9 is generally fixed on a blade support 10, which is pivotable, in the direction shown by arrow 12, about an rotational axis 11. This pivoting enables the chambered doctor blade 9 to be brought in a horizontal position in which, for example, the chambered doctor blade may be cleaned or replaced, the end seals renewed, and, finally, the blade completely removed. These are often relatively tedious operations requiring the use of tools for loosening the fixing means of the chambered doctor blade 9 from its support 10.

Figure 2:
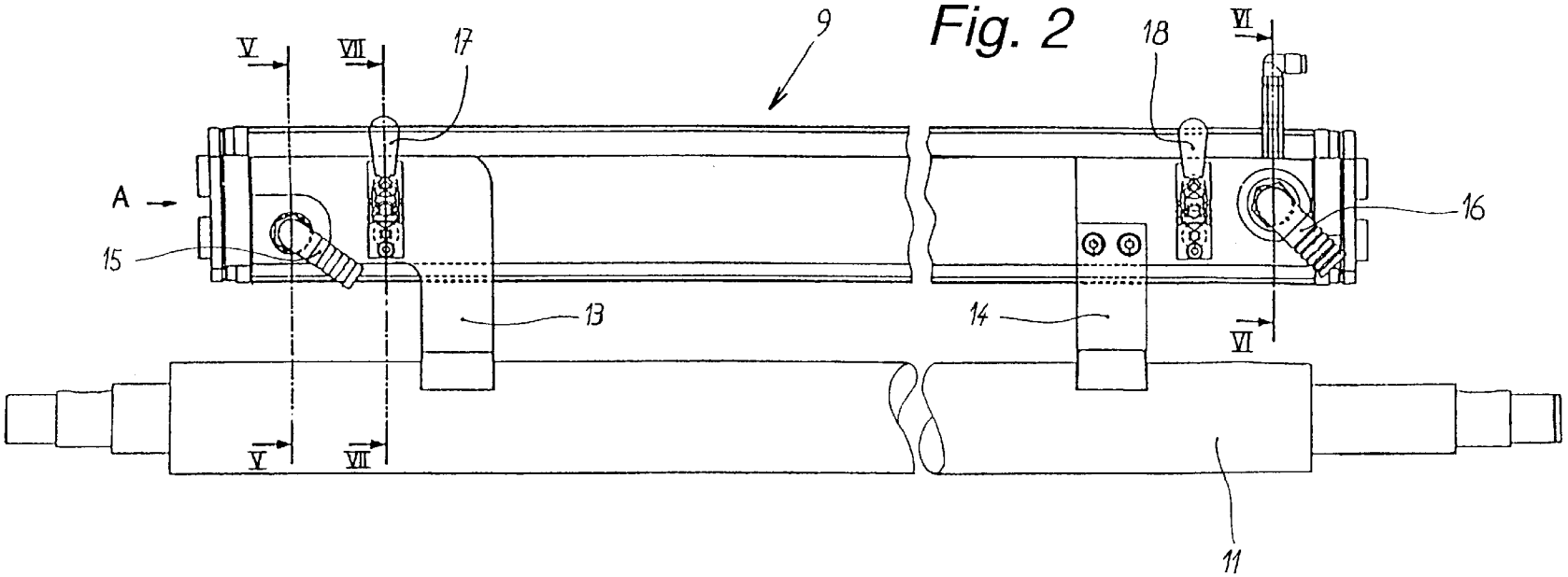
FIG. 2 is rear view, in elevation, of a chambered doctor blade.

FIG. 2 is a rear view, in elevation, of a chambered doctor blade 9 illustrating the manner of connecting the chambered doctor blade 9 with its rotational axis 11 by means of a support assembly including lever-supports 13 and 14 in which are fastened fittings such as nipples 15 and 16 for the supply and return of the ink in the chambered doctor blade 9. The connection between the lever-supports 13 and 14 and the chambered doctor blade 9 is ensured by means of seals 38, 39 (see FIGS. 5 and 6), so that the chambered doctor blade 9 can be disconnected from its levers-supports 13 and 14 without having to remove the ducts supplying or withdrawing the ink from the chambered doctor blade 9. This kind of connection between the chambered doctor blade 9 and its levers-supports 13 and 14 allows a simple extraction without any problem of the chambered doctor blade 9 from the printing station 1 so that all the required handling operations can be performed outside the machine. The lever-supports 13 and 14 are moreover equipped with centering and fixing means 17 and 18. These centering and fixing means 17 and 18 are of any suitable commercially availabe type and are well-known to those skilled in the art. These allow a quick loosening of the chambered doctor blade 9 without the help of any tool.

Figure 3:
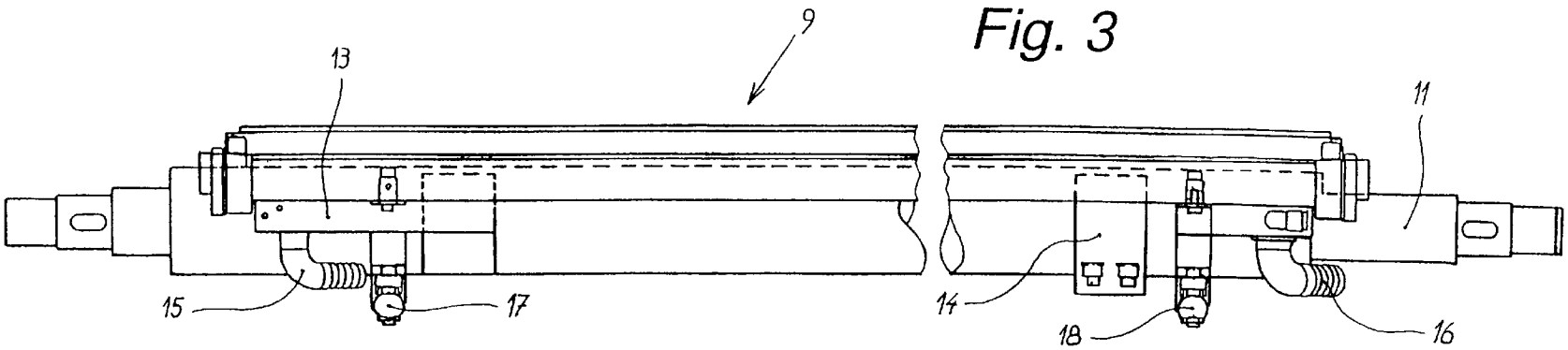
FIG. 3 is a plan view of the chambered doctor blade of FIG. 2.

FIG. 3 is a top plan view of the chambered doctor blade of FIG. 2 representing the various components of FIG. 2 with identical reference numerals.

Figure 4:
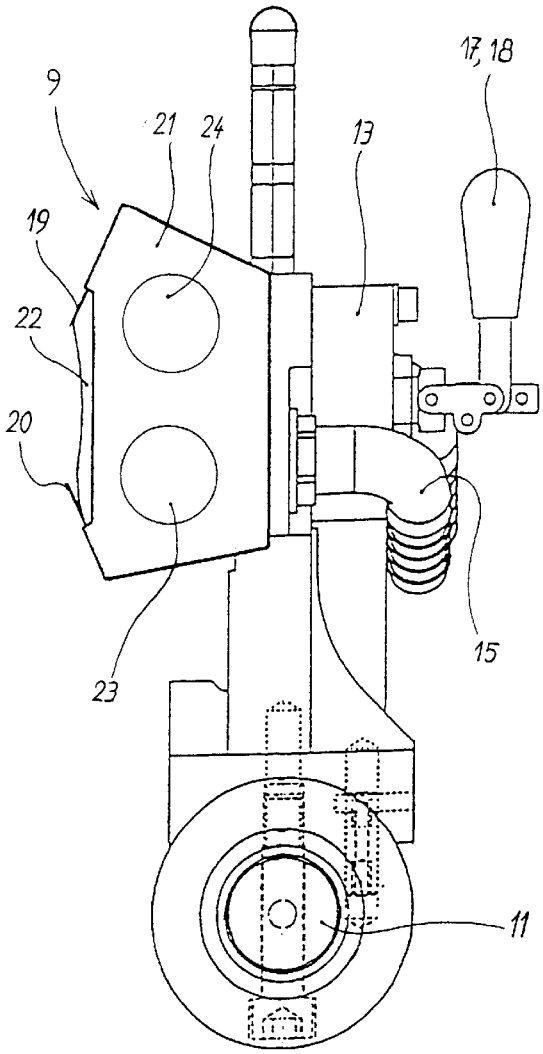
FIG. 4 is a view according to A of FIG. 2.

FIG. 4 is a view looking in the direction of arrow A of FIG. 2 representing one of the ends of the chambered doctor blade 9. This figure shows in particular the manner in which upper and lower doctor blade elements 19 and 20 are held at their ends by means of a supporting piece 21 cooperating with the end seal 22 of the chambered doctor blade 9. The supporting piece 21 is secured against the end seal 22 of the chambered doctor blade 9 by means of two knurled screws 23 and 24.

Figure 5:
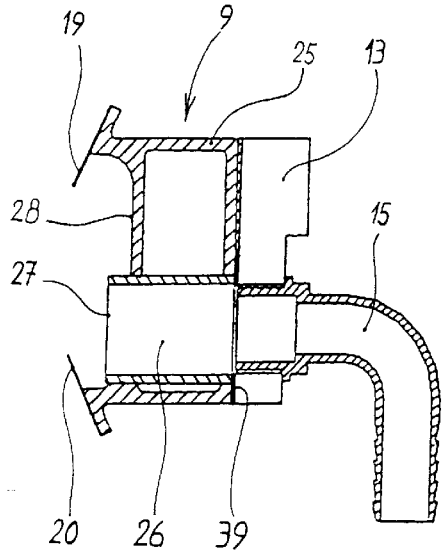
FIG. 5 is a sectional view according to V—V of FIG. 2.

FIG. 5 is a sectional view according to V—V of FIG. 2 representing the body 25 made of aluminium or any other light material such as composite materials, used for the body of the chambered doctor blade 9. The outlet 27 of the ink tube 26 emerges from the bottom 28 of the chambered doctor blade body 9 so as to avoid escapement of the residual ink from the chambered doctor blade 9 when withdrawing it from the printing station 1 and, for example, during its transport to a cleaning station provided in the press room. This figure also shows the seal 39 arranged in the lever-support 13 and ensuring the tightness between the chambered doctor blade 9 and said lever-support 13. The doctor blades 19 and 20 are also shown in this figure and the manner of fixing them to the chambered doctor blade body 9 will be given further in the present description.

Figure 6:
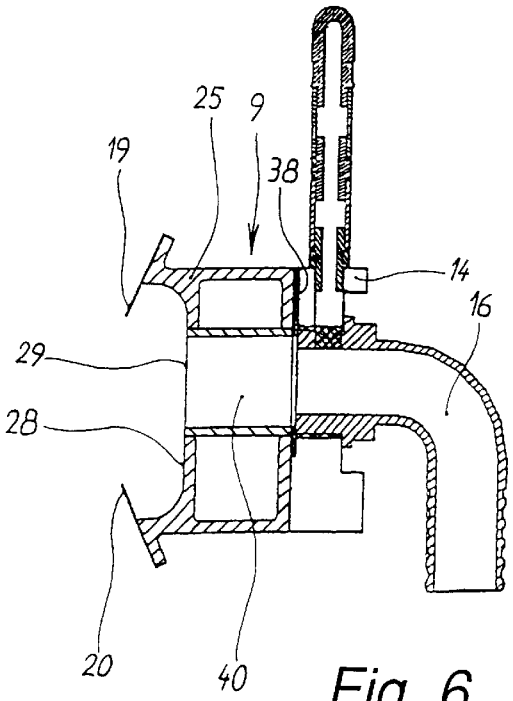
FIG. 6 is a sectional view according to VI—VI of FIG. 2.

FIG. 6 is a sectional view according to VI—VI of FIG. 2 showing the ink supply tube 40 connected to the joining piece 16. The opening part of the ink supply tube 40 is at level with the bottom 28 of the chambered doctor blade body 9 to provide an almost complete outflow of the ink remaining in the chambered doctor blade 9 when the machine is not in operation. As will be seen hereinafter, this opening will be sealed by an adequate seal belonging to a safety and handling device of the chambered doctor blade 9.

FIG. 7 is a perspective view of one of the ends of the chambered doctor blade 9. The other end of the chambered doctor blade 9 is similarly constructed. FIG. 7 shows the chambered doctor blade 9 in its rest position, i.e. when it is not in contact with the screen cylinder 8. The chambered doctor blade 9 is fitted between two lateral frames 34, only one of which is shown. In particular, this figure shows the manner of holding the ends of the doctor blades 19 and 20 by the supporting piece 21 which has two supporting flanges 35 and 36 that maintain the ends of the doctor blades 19 and 20 in contact with their supporting surfaces on the end seal 22. Also represented here is the guiding slide 37 which allows easy positioning of a manipulator 55 (see FIG. 8) on the chambered doctor blade 9 when it is to be withdrawn from the printing station 1. The guiding slide 37 is fitted against the internal surface of each lateral frame 34 by means of screws (not shown).

FIG. 7 clearly shows that the doctor blade elements 19 and 20 are not held by mechanical means. The doctor blade elements 19 and 20 are made of a non-oxidizing steel strip whose thickness may vary in dependence on the jobs to be carried out but preferably having a thickness of 0.15 to 0.2 mm. This non-oxidizing steel strip receives, before being applied against the upper supporting surfaces of the chambered doctor blade 9 and after having been degreased and dried, a gluing means 48, e.g. an adhesive layer. The non-oxidizing steel strip provided with the gluing means 48 is then mechanically applied, with a certain pressure, against the supporting surfaces of the chambered doctor blade body 9. This solution thus enables complete removal of the capillarity effect, which arises with conventional fixing means of doctor blades, and also allows the exchange of damaged or used doctor blade elements 19 and 20 by peeling, using the same apparatus as for the gluing of the doctor blades 19 and 20. The combination of a light chambered doctor blade body and adhesive attachment of the doctor blade elements provides a chambered doctor blade having a considerably lighter weight than the existing chambered doctor blades, thus allowing easy handling.

This easy handling of the chambered doctor blade 9 as well as the simplicity of removal from the machine thus allow quick exchange with another chambered doctor blade which has been previously cleaned and possibly repaired outside the machine by means of auxiliary devices which will be described now. The advantage of operating outside the machine is that it is simultaneously possible to carry out printing jobs and prepare intending tasks "en temps masque". A manipulator 55 is used to extract the chambered doctor blade 9 from the printing station 1, thus keeping an excellent safety level.

FIG. 8 shows one of the ends of a manipulator 55. The other end being practically similar, apart from a sealing mechanism 56, it will not be described here. The manipulator 55 consists of a channel member 57 adapted to cover the upper part of the chambered doctor blade 9. This channel member 57 is equipped with two fixing or securing devices 58 (only one of which being shown in this figure, the other, identical one, being located at the same place at the other end of the channel member 57).

In addition, each end of channel member 57 is provided with a guiding block 59 which facilitates the positioning of the manipulator 55. The guiding blocks 59 engage the guiding slides 37 shown in FIG. 7.

The sealing mechanism 56 is compised of a conical seal 60 mounted on the upper part of the channel member 57. The conical seal 60 is adapted to seal the outlet 29 of the ink supply tube 40 so as to prevent leakage from the chambered doctor blade 9 when it is to be extracted from the printing station 1. The securing device 58 consists of a plate 63, which is pivotally mounted about an axis 64 on the upper part of the channel 57. The plate 63 is provided with two small clamping plates 65 and 66 carried by a spacer 67, 68 respectively. The small clamping plates 65 and 66 have a slanted plane such as 69 acting as cams when rotating opposite to the direction shown by the. arrow 70, against the lower surface of the chambered doctor blade 9, thus securing it to the manipulator 55, as shown in the present figure. Security device 58 is locked in the clamping position shown in this figure, by means of a bolt 71, which is manually actuated so as to allow rotation, in the direction shown by the arrow 70, of the securing device 58 when it is required to withdraw the manipulator 55 from the chambered doctor blade 9. Each plate 63 is additionally provided with a handle 72. This system allows locking and unlocking of the manipulator 55 with only one finger without releasing the transporting handles 72. One of these auxiliary devices, required for the abovementioned handling of the chambered doctor blade 9, consists of an apparatus such as the one represented in FIG. 8.

FIG. 9 shows an automatic washing device 80 for cleaning the chambered doctor blade 9 outside the machine. This device consists of a frame 81, inside of which moves a washing head 82 along the chambered doctor blade 9 which has been previously placed on two hollow supports 83 and 84 by means of the manipulator 55. The support 84 is provided with a centering pin 85 which makes the adjusting of the placing of the chambered doctor blade 9 on these supports easier. The washing head 82 is equipped with two rotary brushes 86 and 87 as well as a plurality of washing nozzles 88. The rotary brushes 86 and 87 are arranged so as to be able to clean at best the surfaces of the doctor blades 19 and 20, and the nozzles 88 are judiciously oriented so as to remove all ink residues on the chambered doctor blade 9.

The displacement of the washing head along the chambered doctor blade is ensured by a motor mounted in a casing 89 on the washing head 82, which moves along a toothed belt 90 fixedly tightened between the lateral walls of the frame 81. This bidirectional displacement is guided by a cylindrical bar 91 and a carrying rail 92. The front surface of the latter is equipped with two supports 93 and 94 adapted to receive the manipulator 55 for storing it. Finally, a control panel 95 allows controlling of said washing device 80.

FIG. 10 is a general perspective view of the device 100 for gluing and ungluing the doctor blade elements 19 and 20 to and from the chambered doctor blade 9. This device comprises a table 101 on which are attached securing jigs 102 to facilitate the adequate positioning of the chambered doctor blade 9 in the device 100. Two longitudinal semicircular receptacles 103 and 104 are located on opposite sides of jigs 102 for directly receiving the respective used doctor blades 19 and 20 when they are removed from the chambered doctor blade 9 by the present device 100.

Along the longitudinal edes of the table 1 01 are mounted two bars 105, 106 on which travels a carriage 107 consisting of two half plates 108, 109 which slide on the bars 105, 106 by means of two pairs of blocks 110. The two half plates are secured to one another by a circular rail 111 screwed on their upper surface. On this circular rail turns a large ring 112 on which is mounted a gluing-ungluing station 120. The displacement of the carriage 107 can be done manually by means of a handle 113 the carriage can be motorized. A desk 114 allows to control the compressed air supply system of certain parts of the gluing-ungluing station 120, more particularly the parts for application, sectioning, degreasing and drying of the doctor blade elements.

FIG. 11 is a perspective view of the gluing-ungluing station 120 of the corresponding device 100. This includes a slanted plate 121, on the front surface of which are mounted various components for the automatic placing of, firstly, a gluing means 48 (FIG. 12) against a metal strip 126, then secondly and simultaneously, pressing strip 126 against the two supporting surfaces forming the lips of the chambered doctor blade body 9. Being sectioned to the right length, strip 126, in the end, forms the doctor blade elements 19 and 20 mounted on the chambered doctor blade body 9.

In a preferred but non-limitative embodiment, the gluing means 48 is a double-faced adhesive tape fed from a supply roller 122, which is rotatably mounted on the front surface of the plate 121. As shown in FIG. 12, this adhesive tape is covered by two removable protective tapes 123 and 125. Upper protective tape 125 passes in the following order, around rods 130, 131 and 132. Lower protective tape 123 passes around rods 130, 134, 135, 136 and 132. After being separated from the adhesive tape 48, the two protective tapes 123 and 125 both pass around a driven collector shaft 137, against which a tension roller 138 is applied, then winds around a rewinder shaft 139. A support 128 for a metal strip roller 127, is also mounted on plate 121.

A housing 140, which is likewise fitted against the latter, contains the cleaning device or station for strip 126. The latter comprises a sprayer 141 (FIG. 12) for spraying a degreaser and a dryer. The fluid is contained in a tank 142 located above the housing 140. A vertical bent channel 143 is used to support compressed air ducts which open into the housing 140 and are connected to the control desk 114 (FIG. 10). During cleaning, the strip 126 passes in a supply channel 144 being topped at one end with a guiding box 145 for adjusting the adhesive tape 48, which has been separated from its upper protective tape 125, against the cleaned surface of strip 126 in order to glue it. Then, the latter passes around a drive shaft 146 before the second protective surface 123 is separated from the adhesive tape 48 at the level of the rod 134. At this stage, strip 126 is already in a pressing mechanism 147 such as a roller or a pressure shoe which applies the adhesive surface of the latter against the upper supporting surfaces of the chambered doctor blade body 9. A cutter 148 for strip 126 is located directly behind and above this pressure means 147 and comprises a guillotine actuated by a cylinder. The pressure means 147 and the cutter 148 are both likewise pneumatically controlled by the desk 114.

The gluing-ungluing station 120 is turnable in a vertical plane owing to circular rail 111 and the ring 112, so that the gluing and ungluing operations can be carried out on both lips of the chambered doctor blade body. The accuracy of the angular rotation of the means 120 is ensured by a finger 149 adjusting in perforated holes in the circular rail 111. The used or damaged doctor blades are unglued by an ungluing mechanism 150 which is mounted against the upper surface of the ring 112. This lifts the doctor blade by a tail provided at one of its ends and unglues it, with the adhesive tape, and drops into the receptacles 103, 104 having the shape of gutters (FIG. 10).

FIG. 12 is a front view of the front part of the plate 121 on which are mounted the various elements previously described with reference to FIG. 11. According to the different arrows in this drawing, the latter illustrates the paths of strip 126, the adhesive tape 48 and the two protective tapes 123 and 125. Two belts 151 and 152 are also represented, though being located behind the plate 121 on pulleys secured to the shafts 139 and 146 for the belt 151, and 137 and 146 for the belt 152. Obviously, the pulley (having two grooves) of the shaft 146 is driven by the unwinding of the strip 126 applied on the upper supporting surfaces of the chambered doctor blade body, thus advantageously avoiding any adverse synchronism between the unwinding speed of this foil and the displacement speed of the carriage 107 along the bars 105,106.

Numerous improvements can be made to this device, embodiment, cleaning and use in a flexographic printing machine within the scope of the claims.

What is claimed is:

1. A detachable inking device for a flexographic printing machine comprising:

a chambered doctor blade; and a support assembly for detachably supporting the chambered doctor blade, the support assembly being movable to bring the chambered doctor blade into and out of engagement with a screen roll on the printing machine;

the chambered doctor blade being comprised of:

a light-weight body having first and second ends, the body being elongated in the direction of a rotational axis of the screen roll;

an end piece detachably secured at each end of the body;

upper and lower lip portions projecting outwardly from the body, and extending the length of the body, each lip portion having a planar end face; and first and second doctor blade elements adhesively attached respectively to the end faces of the upper and lower lip portions, whereby the body, the end pieces and the doctor blade elements form an inking chamber for the screen roll, said support assembly being comprised of:

first and second mounting arms supported on a shaft that is mounted on the frame of the printing machine, the shaft being pivotable to move the chambered doctor blade into and out of engagement with the screen roll; and first and second disconnect mechanisms located respectively on each of the mounting arms, and which are manually operable without assistance of a tool to release the chambered doctor blade from the support assembly.

2. A detachable inking device as described in claim 1, wherein:

the first support arm further includes an ink inlet passage which terminates in a fitting connectable to an inlet line from an ink reservoir;

the second support arm further includes an ink outlet passage which terminates in a fitting connectable respectively to a return line to the ink reservoir;

the chambered doctor blade body includes first and second passages respectively aligned with the ink inlet and outlet passages in the support arms, and which open into the inking chamber, with the second passage at a lower level than the first passage when the chambered doctor blade is positioned to engage with the screen roll.

3. A detachable inking device as described in claim 2, wherein the first and second support arms include seals which engage with the chambered doctor blade.

4. A detachable inking device as described in claim 1, further including a disconnect mechanism which is manually operable without assistance of a tool to release the chambered doctor blade from the support assembly.

5. A detachable inking device as described in claim 1, wherein:

the support assembly further includes ink inlet and outlet passages respectively connectable to supply and return lines from an ink reservoir;

the chambered doctor blade body includes first and second passages respectively aligned with the ink inlet and outlet passages in the support arms, and which open into the inking chamber, with the second passage at a lower level than the first passage when the chambered doctor blade is positioned to engage with the screen roll; and further including a sealing structure between the support assembly and the chambered doctor blade.

6. A detachable inking device as described in claim 1, wherein:

the end faces of the lip portions are outwardly slanted; and the first and second doctor blade elements are further held in place at their respective ends by flanges extending from the end pieces and overlying the ends of the doctor blade elements.

7. A detachable inking device as described in claim 1, wherein the end pieces are attached to the chambered doctor blade body by threaded fasteners.

* * * * *